US005433303A

United States Patent [19]

Chen

[11] Patent Number: 5,433,303

[45] Date of Patent: Jul. 18, 1995

[54] FOLDABLE FRAME FOR A CASE

[76] Inventor: Chi-Lu Chen, 7th Fl.-1, No. 98, Sec. 2, Nanking E. Rd., Taipei, Taiwan

[21] Appl. No.: 191,800

[22] Filed: Feb. 3, 1994

[51] Int. Cl.[6] ..... A45C 7/00; A45C 13/04; A45C 13/36

[52] U.S. Cl. ..... 190/107; 190/24; 190/122; 190/127

[58] Field of Search ..... 190/103–105, 190/107, 124, 125, 122, 127, 24; 220/4.29, 4.32

[56] References Cited

U.S. PATENT DOCUMENTS

| | | | |
|---|---|---|---|
| 1,019,547 | 3/1912 | Spiro | 190/127 |
| 1,573,721 | 2/1926 | Loeffler | 190/107 |
| 1,834,740 | 12/1931 | Rhettt | 190/107 |
| 2,416,783 | 3/1947 | Vallieres | 190/107 |
| 2,710,084 | 6/1955 | Braverman | 190/113 X |
| 2,718,943 | 9/1955 | Braverman | 190/107 |
| 2,798,579 | 7/1957 | Fox | 190/107 X |
| 2,903,033 | 9/1959 | Robinson | 190/122 |
| 3,504,722 | 4/1970 | Barry | 190/113 X |
| 4,176,734 | 12/1979 | Wang | 190/122 |
| 5,303,805 | 4/1994 | Hauser | 190/107 |

FOREIGN PATENT DOCUMENTS

| | | | |
|---|---|---|---|
| 544391 | 9/1959 | Belgium | 190/113 |
| 550901 | 12/1959 | Belgium | 190/122 |
| 872072 | 6/1971 | Canada | 190/103 |
| 384449 | 8/1990 | European Pat. Off. | 190/127 |
| 1062255 | 4/1954 | France | 190/122 |
| 8809135 | 12/1988 | WIPO | 190/122 |

*Primary Examiner*—Sue A. Weaver

[57] ABSTRACT

A case with a collapsible frame. The collapsible frame has four straight walls and four connectors. Any two continuous straight walls are connected to each other by means of a connector. Each connector has a link assembly and a buckle assembly which consists of a female buckle and a male buckle. A straight wall is linked to the link assembly which is further linked to the male buckle which is engaged with the female buckle which is linked to another straight wall. The link assembly has several links. Any two continuous links have a first relative position so that they are allowed to pivot relative to each other and a second position so that they are kept from pivoting with respect to each other. The frame is collapsible when the links are in the first relative position and the female buckle is disengaged from the male buckle. The case occupies small space when the frame is folded. A frame is formed when the links are in the second relative position and the female buckle is engaged with the male buckle.

4 Claims, 5 Drawing Sheets

FOLDABLE FRAME FOR A CASE

BACKGROUND OF INVENTION

This invention relates to a collapsible frame for a case, such as a suitcase.

Cases, and suitcases in particular, are very useful for transporting clothes etc. on vacation and the like. Currently available cases include those that are rigid and those that are flexible. The rigid cases may have better protection of their content against foreign impacts, however, they occupy larger space when they are not in use. The flexible cases may have less protection of their contents, however, they occupy less space when they are not in use. Therefore, there are some drawbacks in each of the conventional cases.

SUMMARY OF INVENTION

It is the primary object of this invention to provide a case which provides a sufficient protection of its content and occupies small space when it is not in use.

The primary object of this invention is achieved by providing a case which uses a collapsible frame. The collapsible frame has four straight walls and four connectors. Any two continuous straight walls are connected to each other by means of a connector. Each connector has a link assembly and a buckle assembly which consists of a female buckle and a male buckle. A straight wall is linked to the link assembly which is further linked to the male buckle which is engaged with the female buckle which is linked to another straight wall. The link assembly has several links. Any two continuous links have a first relative position so that they are allowed to pivot relative to each other and a second position so that they are kept from pivoting with respect to each other. The frame is collapsible when the links are in the first relative position and the female buckle is disengaged from the male buckle. The case occupies a small space when the frame is folded. A frame is formed when the links are in the second relative position and the female buckle is engaged with the male buckle.

For a better understanding of the present invention and objects thereof, a study of the detailed description of the embodiments described hereinafter should be made in relation to the accompanying drawings.

DETAILED DESCRIPTION OF PREFERRED EMBODIMENT

Figure 1:
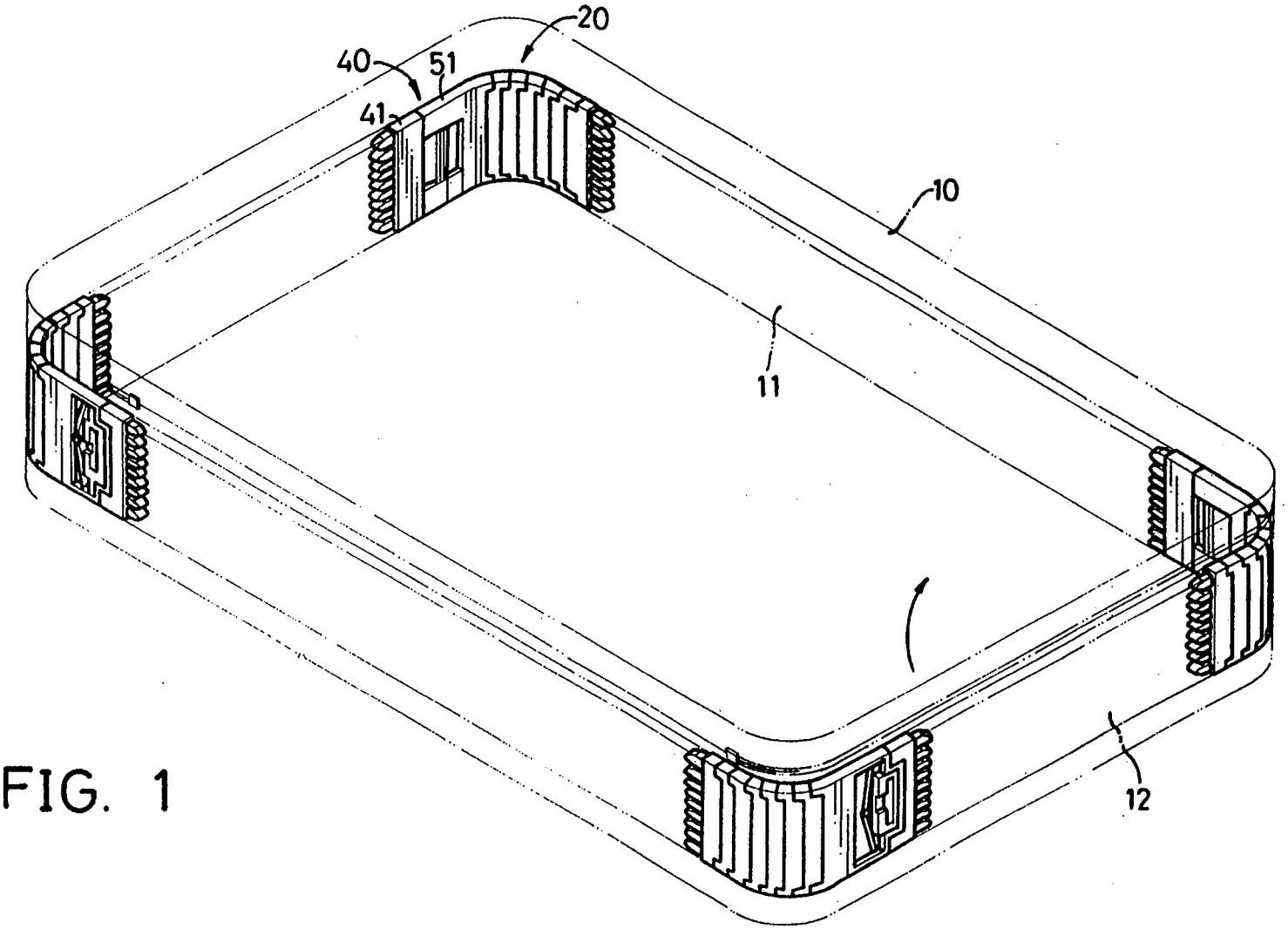
FIG. 1 is a perspective view of a case which employs a collapsible frame in accordance with the first embodiment of the present invention.

Referring to FIG. 1, a case 10 uses a collapsible frame which has two long straight walls 11, two short straight walls 12 and four connectors 20 in accordance with the first embodiment of the present invention. The long straight walls 11 are opposed to each other. The short walls 12 are opposed to each other. Thus, the straight walls 11 and 12 form a substantially rectangular frame when they are joined together by means of the connectors 20. Each long straight wall 11 is connected to an adjacent short wall 12 by means of a corresponding connector 20. The walls 11 and 12 are rigid for providing protection of the content of the case.

Each connector 20 has a link assembly 30 and a buckle assembly 40 which consists of a female buckle 41 and a male buckle 51. The link assembly 30 is connected with the buckle assembly 40. The link assembly 30 of a connector 20 at the top left corner of the case 10 is linked to a long wall 11 at the top. The buckle assembly 40 of the connector 20 at the top left corner is linked to a short wall 12 at the left. The link assembly 30 of a connector 20 at the bottom left corner is linked to the short wall 12 at the left. The buckle assembly 40 of the connector 20 at the bottom left corner is linked to a long wall 11 at the bottom. The link assembly 30 of a connector 20 at the bottom right corner is linked to the long wall 11 at the bottom. The buckle assembly 40 of the connector 20 at the bottom right corner is linked to a short wall 12 at the right. The link assembly 30 of a connector 20 at the top right corner is linked to the short wall 12 at the top. Each link assembly 30 is foldable. Thus, the left short straight wall 12 is foldable toward the upper long straight wall 11 when the female buckle 41 of the left lower connector 20 is disengaged from the male buckle 51 of the same.

Figure 2:
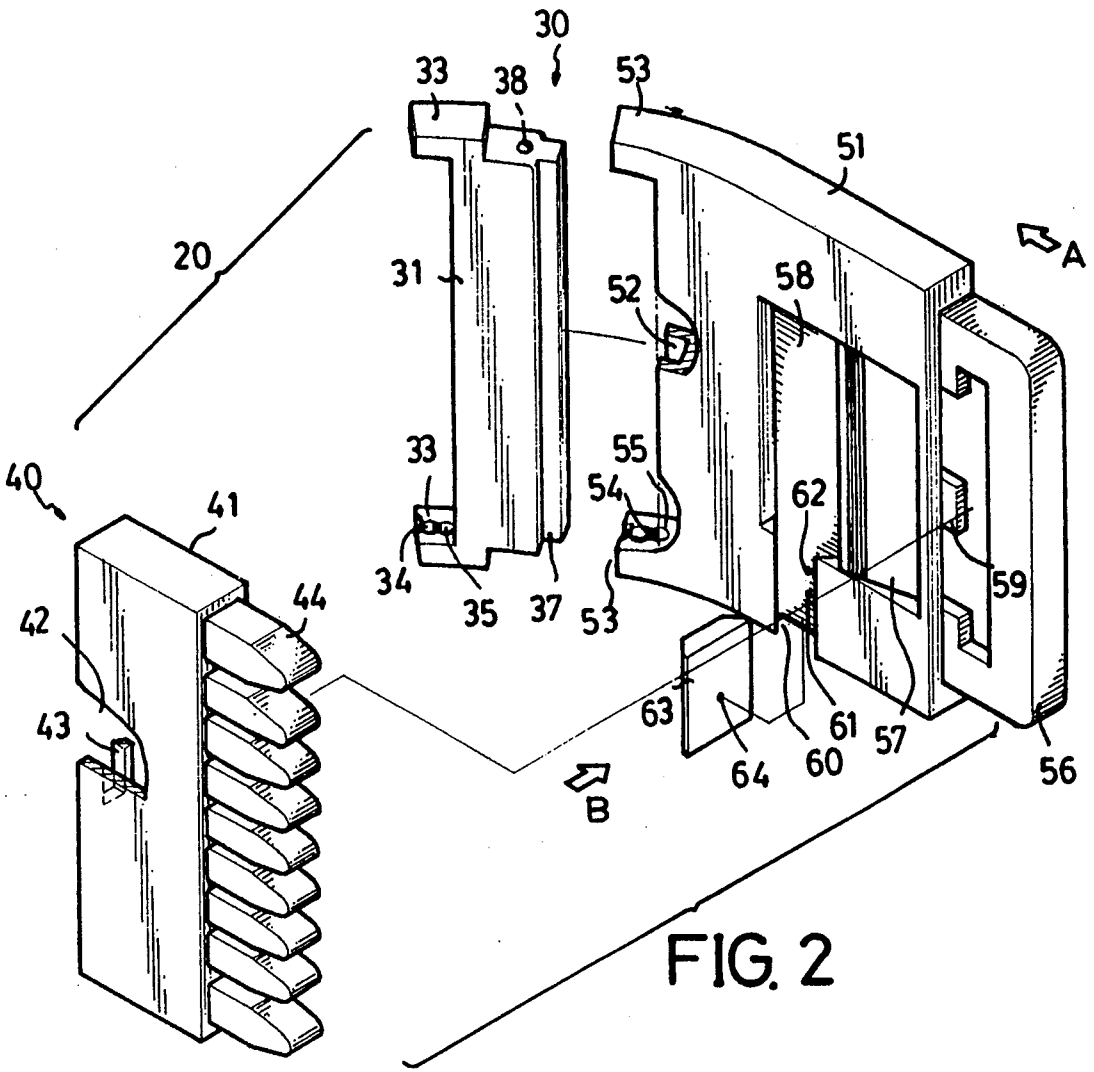
FIG. 2 is an exploded view of a connector which is in use in the frame of the case as shown in FIG. 1.

Referring to FIG. 2, the link assembly 30 consists of several links 31 (only one is shown). Each link 31 is shaped as an arc when it is shown in a top view. Each link 31 has a first lateral edge, a second lateral edge which is opposite to the first lateral edge, an upper edge and a lower edge. A slot 32 (see FIG. 3) is longitudinally defined in the first lateral edge of each link 31. An ear 33 is formed on the upper edge of the link 31 and another ear 33 is formed on the lower edge of the link 31. The distance between the ears 33 is marginally larger than the length of the second lateral edge of the link 31 so that the second lateral edge of a link 31 can be disposed between the ears 33 of another link 31. Two recesses 34 and 35 are defined in each ear 33 such that they partially overlap each other so as to form a rim between them. Instead of a ridge, several teeth are formed on the second lateral edge of one of the links 31 which is furthest from the buckle assembly 20. The teeth formed on the link 31 are insertable into a corresponding number of recessed (not numbered) defined in one of the walls 11 and 12 for engaging one of the link assembly 30 with one of the walls 11 and 12.

A ridge 37 is longitudinally formed on the second lateral edge of each link 31. A boss 38 is formed on the top of each link 31 while another boss 38 is formed on the bottom of each link 31. To form the link assembly 30, the second lateral edge of a link 31 is disposed between the ears 33 of another link 31 so that the bosses 38 of a link 31 are received in the recesses 34 or 35 of another link 31.

Figure 3:
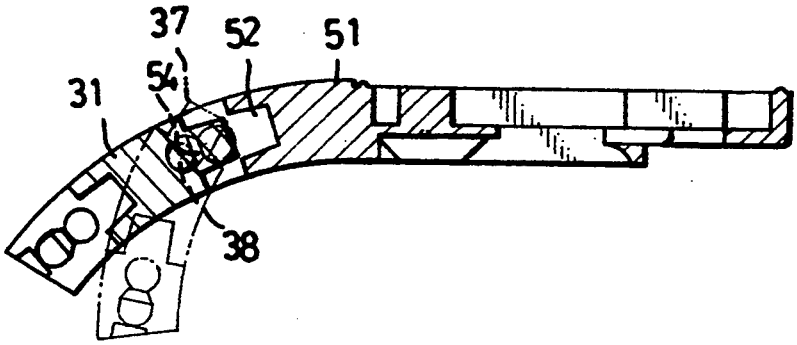
FIG. 3 is a horizontal cross-sectional view of a pivoting assembly and a male buckle which are in use in the connector as shown in FIG. 2, showing that they are retained in a first relative position.

Referring to FIG. 3, the bosses 38 of a link 31 are received in the recesses 34 of another link 31 so that the ridge 37 of the first link 31 is disengaged from the slot 32 of the second link 31 so that a link 31 is allowed to pivot with respect to another link 31. That is, the link assembly 30 is foldable.

Figure 4:
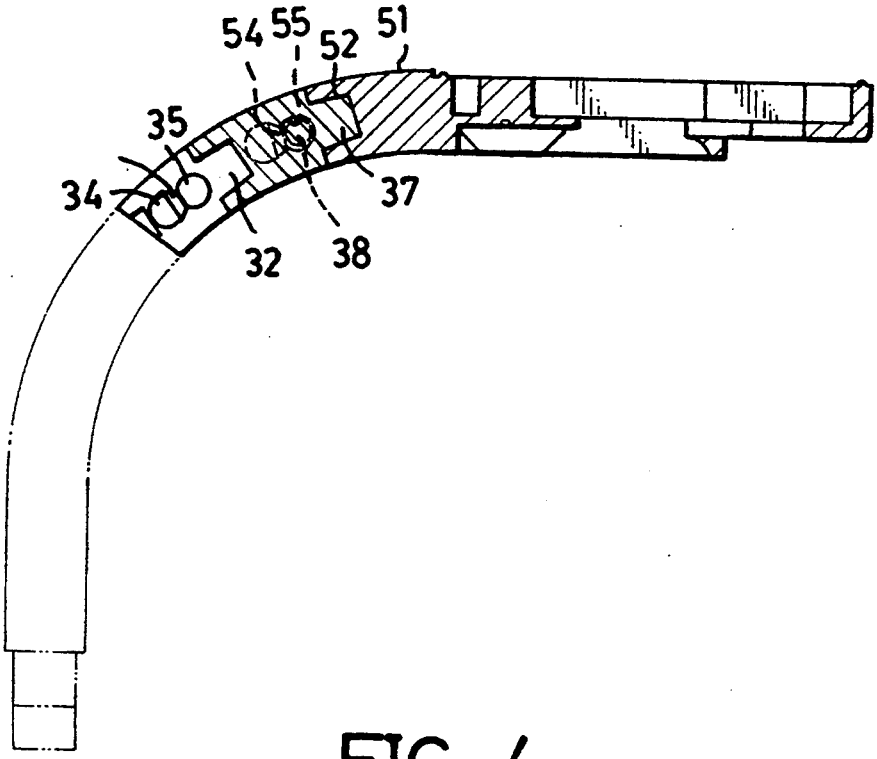
FIG. 4 is a horizontal cross-sectional view similar to FIG. 3, but showing that the pivoting assembly and the male buckle are in a second position relative to each other.

Referring to FIG. 4, the bosses 38 of a link 31 are engaged in the recesses 35 of another link 31 so that the ridge 37 of a link 31 is received in the slot 32 of another link 31. Thus, the first link 31 is kept from pivoting relative to the second link 31. That is, the link assembly 30 is thus retained in position.

Referring again to FIG. 2, the female buckle 41 has a plate with a first lateral edge and a second lateral edge which is opposite to the first lateral edge. A tab 43, through which a hole is defined, perpendicularly projects from a side of the plate near the first lateral edge. Several teeth 44 project from the second lateral edge of the plate. The teeth 44 are engaged in several recesses (not shown) which are defined in a short wall 12 so that the female buckle 41 is linked to the short wall 12.

The male buckle 51 has a first lateral edge and a second lateral edge which is opposite to the first lateral edge. A slot 52 is longitudinally defined in the first lateral edge of the male buckle 51. An ear 53 is formed on an upper end of the first lateral edge of the male buckle 51 while another ear 53 is formed on a lower end of the first lateral edge of the male buckle 51. Two recesses 54 and 55 are defined in each ear 53. The slot 52 is similar to the slot 32 in structure and function. The ears 53 are similar to the ears 33 in structure and function. The recesses 54 and 55 are similar to the recesses 34 and 35 in structure and function. Thus, a link 31 can be linked to the male buckle 51. The link 31 is pivotable with respect to the male buckle 51 as the bosses 38 of the former are received in the recesses 54 of the latter. The link 31 is kept from pivoting relative to the male buckle 51 as the bosses 38 of the former are received in the recesses 55 of the latter.

A C-shaped portion 56 is formed on the second lateral edge of the male buckle 51. A spring-biased latch 57 with a first lateral edge and a second lateral edge is received in a space 58 which is defined in the male buckle 51. A tongue 59 projects from the second lateral edge of the spring-biased latch 57. A dovetail slot 60 is defined in the male buckle 51. The space 58 is above the dovetail slot 60, the former is in communication with the latter. Two recesses 61 and 62 are defined in the dovetail slot 60 the former is below the latter. A dovetail 63 on which a boss 64 is formed is engageable with the dovetail slot 60.

To engage the female buckle 41 with the male buckle 51, the spring-biased latch 57 is moved in a direction as indicated with an arrow A so that the tongue 59 is moved out of the C-shaped portion 56. The female buckle 41 is moved toward the male buckle 51 in a direction as indicated with an arrow B so that the tab 43 is inserted in the C-shaped portion 56. The spring-biased latch 57 is then released so that the tongue 59 is inserted in the hole which is defined through the tab 43.

Figure 5:
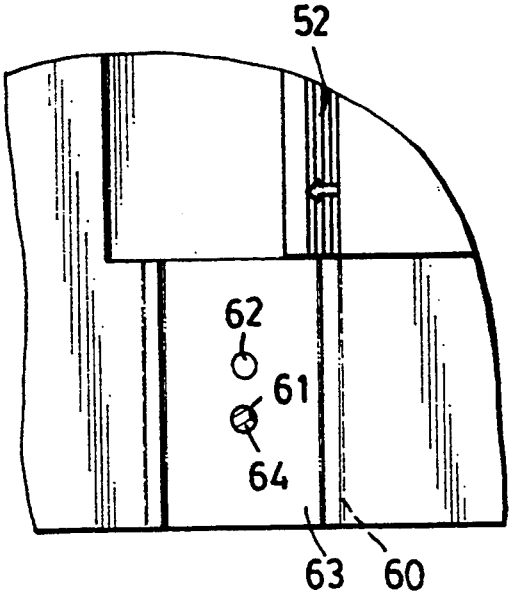
FIG. 5 is an enlarged partial view of a dovetail and a latch both of which are retained in the male buckling member wherein the dovetail is retained in first position so as to allow the latch to slide.

Referring to FIG. 5, as the boss 64 is received in the recess 61, the spring-biased latch 57 is not trapped by means of the dovetail 63. The spring-biased latch 57 is thus allowed to slide in the space 58 along a direction as indicated with arrow A (see FIG. 2), i.e., the tongue 59 is disengageable from the hole which is defined through the tab 43. As a result, the female buckle 41 is disengageable from the male buckle 51.

Figure 6:
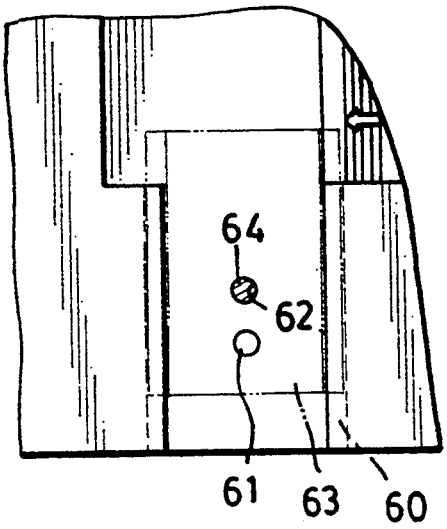
FIG. 6 is an enlarged partial view similar to FIG. 5 but showing the dovetail retained in a second position so as to lock the latch.

Referring to FIG. 6, as the boss 64 is received in the recess 62, an upper portion of the dovetail 63 traps a lower portion of the spring-biased latch 57. The spring-biased latch 57 is thus kept from moving in the direction as indicated with arrow A (see FIG. 2), i.e., the tongue 59 is retained in the hole which is defined through the tab 43. Thus, the female buckle 41 is locked to the male buckle 51.

Figure 7:
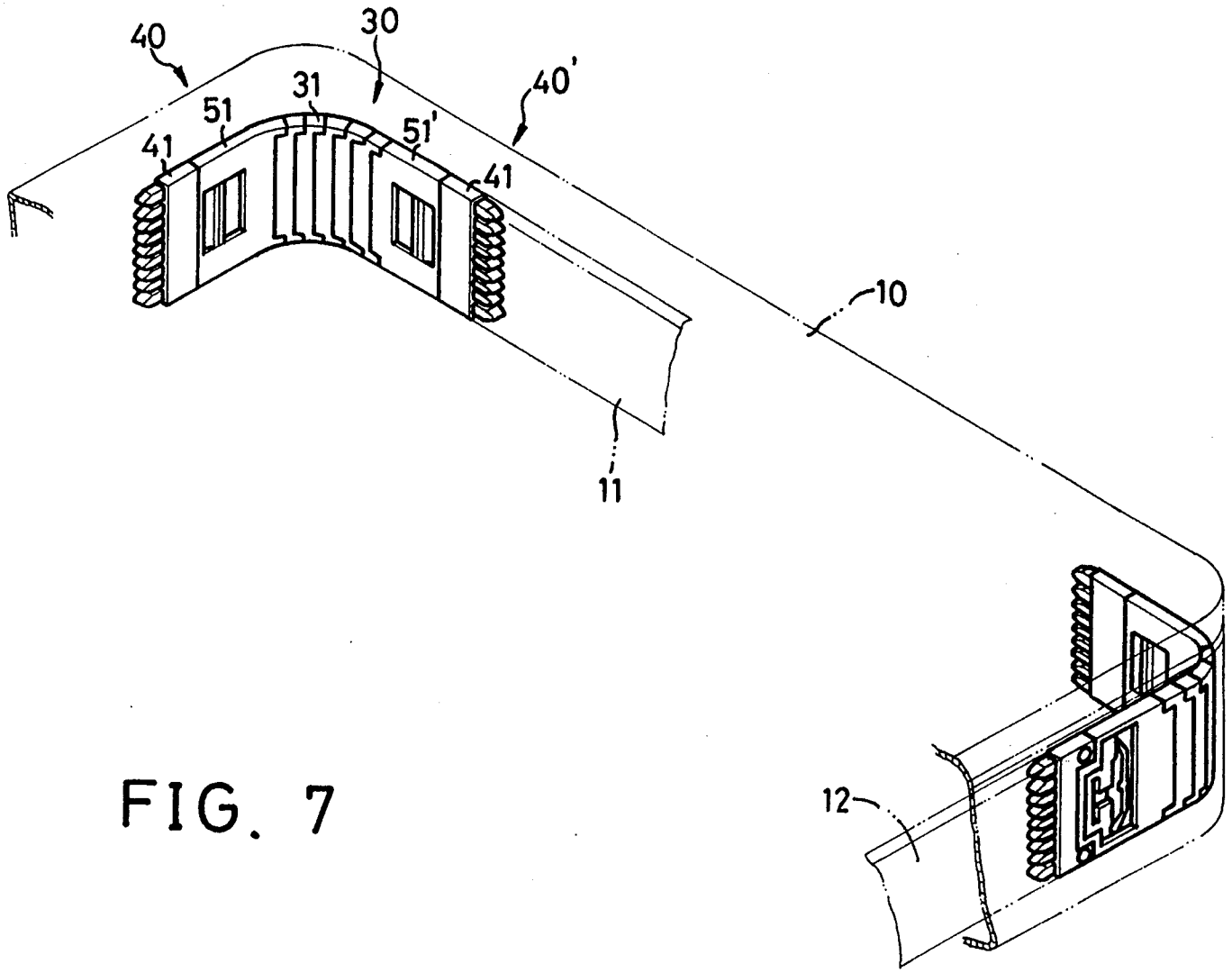
FIG. 7 is a perspective view of a case which employs a collapsible frame in accordance with the second embodiment of the present invention.

Referring to FIG. 7, in accordance with a second embodiment of this invention, each connector 20 consists of a link assembly 30, two buckle assemblies 40 and 40'. The buckle assembly 40 consists of a female buckle 41 and a male buckle 51. The buckle assembly 40' consists of a female buckle 41 and a male buckle 51'. The male buckle 51' is similar to the male buckle 51, therefore, details of the former will not be given.

To collapse the case, lower female buckles 41 are disengaged from the lower male buckles 51, the two short straight walls 12 are folded inward to a position substantially parallel to the upper long straight wail 11, thereby allowing the lower long straight wall 11 connected with a male buckle 51 at each end thereof to be pushed toward the upper straight wall 11, resulting in a reduction of the volume of the case.

While the present invention has been explained in relation to its preferred embodiment, it is to be understood that variations thereof will be apparent to those skilled in the art upon reading this specification. Therefore, the present invention is intended to cover all such variations as shall fall within the scope of the appended claims.

What is claimed is:

1. A case including a collapsible frame comprising four walls being joined together by means of four connectors each comprising a buckle assembly and a link assembly;

the link assembly consisting of several links each comprising a first lateral edge, a second lateral edge opposite to the first lateral edge, and upper edge, a lower edge, an upper ear which is formed on the upper edge thereof adjacent to the first lateral edge and which defines a first recess and a second recess so that the first and second recesses defined therein partially overlap each other, a lower ear which is formed on the lower edge thereof adjacent to the first lateral edge and which defines a first recess and a second recess so that the first and second recesses defined therein partially overlap each other and face the recesses of the upper ear, a slot which is defined in the first edge of the link, a ridge which is formed on the second edge of the link, a boss which is formed on the upper edge of the link near the ridge and another boss which is formed on the lower edge of the link near the ridge;

wherein one of said links is pivotable in respect to another of said links when the bosses of the former are received in the first recesses defined in the upper and lower ears of the latter, and when the bosses of the former are received in the second recesses defined in the upper and lower ears of the latter, the ridge of the former being received in the slot of the latter, retaining the former in position relative to the latter;

the buckle assembly including a female buckle and a male buckle including a first lateral edge, a second lateral edge, opposite to the first lateral edge, an upper edge and a lower edge, an upper ear projecting from the upper edge thereof and defining a first recess and a second recess so that the first and second recesses defined therein partially overlap each other, a lower ear projecting from the lower edge thereof and defining a first recess and a second recess so that the first and second recesses defined therein partially overlap each other and face the recesses of the upper ear, a slot defined in the first lateral edge thereof and disposed between the upper and lower ears;

wherein one of the links is pivotally linked to the male buckle when the bosses of the former are received in the first recesses defined in the upper and lower ears of the latter, and when the bosses of the link are moved into the second recesses defined in the upper and lower ears of the male buckle, the ridge of the former being received in the slot defined in the latter, retaining the former in position relative to the latter.

2. The case in accordance with claim 1 wherein the buckle assembly comprises:

said male buckle including a C-shaped portion formed on the second lateral edge thereof, a space defined in the buckle adjacent to the second lateral edge, a spring-biased latch received in the space defined therein and a tongue extending from the spring-biased latch and disposed to extend beyond the second lateral edge toward the C-shaped portion;

said female buckle including a plate with a first lateral edge and a second lateral edge opposite to the first lateral edge, a tab perpendicularly projecting from the first edge of the plate thereof and defining a hole;

whereby the tongue of the spring-biased latch can be retracted away from the C-shaped portion of the male buckle so that the tab of the female buckle can be moved within the C-shaped portion of the male buckle, the tongue of the spring-biased latch can be extended so as to be inserted into the hole defined in the tab of the female buckle for firmly engaging the male buckle with the female buckle.

3. The case in accordance with claim 2 wherein the male buckle defines a dovetail slot in communication with the space defined therein and comprises a dovetail means slidably received in the dovetail slot between a first position allowing the spring-biased latch to be moved into the dovetail slot for disengaging the tongue from the hole defined through the tab of the female buckle and a second position restraining the spring-biased latch so as to retain the tongue in the hole defined through the tab of the female buckle.

4. The case in accordance with claim 3 wherein the male buckle defines a first recess and a second recess within the dovetail slot, and the dovetail means comprises a boss formed thereon;

wherein the boss of the dovetail means is received in the first recess defined in the dovetail slot when the dovetail means is in the first position, and the boss of the dovetail means is received in the second recess defined in the dovetail slot when the dovetail means is in the second position.

* * * * *